US005754212A

United States Patent [19]

Kintz

[11] Patent Number: 5,754,212

[45] Date of Patent: May 19, 1998

[54] RESISTIVE HEATING TECHNIQUE FOR CREATING PATTERNED ORNAMENTS

[76] Inventor: Gregory J. Kintz, 680 Emily Dr., Mountain View, Calif. 94043

[21] Appl. No.: 439,685

[22] Filed: May 12, 1995

[51] Int. Cl.[6] ..... B41J 2/32

[52] U.S. Cl. ..... 347/171; 358/297

[58] Field of Search ..... 346/76.1, 150.1, 346/150.2; 358/297; 347/171

[56] References Cited

U.S. PATENT DOCUMENTS 5,266,771 11/1993 Van Wyk .
5,378,512 1/1995 Van Wyk .

*Primary Examiner*—Huan H. Tran
*Attorney, Agent, or Firm*—Wilson Sonsini Goodrich & Rosati

[57] ABSTRACT

A resisting heating apparatus for creating a pattern in an interior coating of an interior surface of an ornament includes, a support apparatus for supporting the ornament. Also included is an energy source and a resistive heating apparatus. The resistive heating apparatus includes a resistive heating delivery element with a distal tip that delivers ablative energy from a variety of energy sources to the interior coating of the ornament. A motion control device is associated with the resistive heating apparatus. The motion control device provides movement of the resisting heating delivery element distal tip in two or more orthogonal directions in the interior of the ornament. Further, a signal generating apparatus is connected to the motion control device and produces a signal to the motion control device that results in movement of the resistive heating element and its distal tip along the interior coating to produce the desired pattern. The apparatus is particularly suitable for the creation of Christmas ornaments.

31 Claims, 3 Drawing Sheets

RESISTIVE HEATING TECHNIQUE FOR CREATING PATTERNED ORNAMENTS

BACKGROUND OF THE INVENTION

1. Field of the Invention

This invention relates to decorative ornaments, and more particularly to a resistive heating apparatus and method for forming patterns in decorative ornaments 2. Description of Related Art Many Christmas ornaments are made of a hollow body, typically formed of glass or plastic, which is adapted for hanging from a Christmas tree or display. The body of the ornament is silvered and lacquered in a machine generally referred to as "an S&L machine", which coats the interior surface of the hollow body with a material such as silver. Thereafter, the exterior surface of the hollow body is coated with a coating layer of a desired color.

White light incident on the ornament reflects off of the interior silver coating and provides a bright mirrored ornament. The outer coating layer can be clear to provide a reflecting silver ornament. Alternatively, the outer coating layer may be a relatively transparent, glossy finish paint that provides a colored effect. The outer coating layer may also be a relatively opaque, mat finish layer, providing a more subdued effect.

It is often desirable to place an ornamental design on the ornament. This has been done by painting the design on the exterior of the ornament. It can also be achieved by scribing the pattern on the outer coating layer.

More recently, as reported in U.S. Pat. No. 5,266,771 (hereafter "the '771 patent"), and U.S. Pat. No. 5,378,512 (hereafter "the '512 patent") patterned designs have been formed on an interior coated surface of the ornament.

The '771 patent discloses a method of forming ornamental designs on the interior coated surface of the ornament body by forming a predetermined pattern in the interior coating layer. This is accomplished by the use of directing a laser beam through the ornament body, striking the interior coating layer, and forming the predetermined pattern in the interior coating layer. In the '512 patent, an ornament is disclosed which has the desired pattern formed in the interior coating layer.

However, both the '771 and '512 patents suffer numerous disadvantages. These include the high costs of the laser, the servo mechanisms and other devices necessary to created the pattern, as well as exposure to laser radiation.

It would be desirable to provide a less expensive apparatus for creating a desired ornamental pattern on an ornament. Further, it would be desirable to provide an apparatus for creating the desired pattern with an apparatus that does not expose the user to radiation generated by a laser.

SUMMARY OF THE INVENTION

Accordingly, it is an object of the present invention to provide an apparatus for creating a desired pattern in an interior coating of an interior surface of an ornament.

Another object of the present invention is to provide an apparatus for creating a pattern in at least two orthogonal directions in an interior coating or an interior surface of an ornament.

Yet another object of the present invention is to provide an apparatus for creating patterns on interior surfaces of Christmas ornaments.

Yet another object of the present invention is to provide a resistive heating apparatus for creating a pattern in an interior coating of an interior surface of an ornament.

Yet another object of the present invention is to provide an apparatus for creating a pattern in a Christmas ornament which is less expensive than devices which employ lasers.

Another object of the present invention is to provide an apparatus for creating a pattern in an interior coating of an interior surface of an ornament which does not expose the user to radiation emitted by a laser.

Yet another object of the present invention is to provide an apparatus for creating a pattern in an interior coating of an interior surface of an ornament which is safer than an apparatus which employs a laser.

These and other objects and objectives of the present invention are achieved in an apparatus for creating a pattern in an interior coating of an interior surface of an ornament. Included is a support apparatus for supporting the ornament during the creation of the desired pattern. An energy source supplies electrical energy. A resistive heating apparatus includes a resistive heating delivery element with a distal tip that delivers ablative energy from the energy source to the interior coating of the ornament. A motion control device associated with the resistive heating apparatus provides movement of the resistive heating delivery element distal tip in two or more orthogonal direction in the interior of the ornament. A signal generating apparatus is connected to the motion control device and produces a signal resulting in movement of the resistive heating element and distal tip.

Another embodiment of the present invention is a method of forming a pattern in an interior coating in the interior of an ornament includes providing a resistive heating apparatus, including a resistive heating delivery element with a distal tip that delivers ablation energy from an energy source to the interior coating of the ornament. The resistive heating delivery element is contacted with the interior coating. Electrical energy is delivered from the energy source and the resistive heating delivery element to the interior coating of the ornament. The interior coating is then ablated where it is adjacent to the distal tip of the resistive heating delivery element.

With the apparatus of present invention the ornament can be in a stationary or non-stationary position. The apparatus can further include a ground contact pad which is positioned in the interior of the ornament. A support member supports the ground contact pad in the interior of the ornament. The interior surface of the ornament has a lower conductivity than the interior coating.

The energy source has a first plurality connected to the resistive heating delivery element and a second plurality connected to the interior surface of the ornament. The plurality connected to the interior surface of the ornament is over a large enough area to prevent local heating at that point of contact. When the distal tip of the resistive heating delivery element is in contact with a point on the surface on the ornament interior current flows from the distal tip to the interior surface. As the current leaves this point of contact the current spreads out over the entire interior surface of the ornament. However, at the point of contact the current is strongly localized and causes a resistive heating of the coating material. This causes a rapid heating of the interior coating surface at that point which removes material from the interior coating. Once the material is removed the flow of current stops because the distal tip is no longer in contact with the interior coating material. Instead, the distal tip is now in contact with the ornament material which has a much lower conductivity.

Stopping the ablation process allows the removal of the coating material to occur in a very localized region around the point of contact of the distal tip with the interior coating of the ornament. By moving the distal tip to a new location on the surface of the interior coating, the ablation processes is repeated at this new location. Utilizing any electronic switching technique, the electrical source is turned on and off to produce regions where the surface is ablated and not ablated. In the absence of electrical power, the distal tip can be designed to pass over the surface of the interior coating without mechanically scratching or removing it from the ornament.

Preferably, the interior coating is made of a metallized material. In one embodiment, the distal tip is a single wire, while in another embodiment it is a plurality of contact wires. The plurality of contact wires can form a print head particularly suited for creating photographic images in the interior coating.

A gearing apparatus can move the resistive heating delivery element in an angle θ and a rotation apparatus can move it around an angle ϕ. Further, the apparatus can include a first drive motor connected to a gearing apparatus that moves the resistive heating delivery element in the angle θ and a second drive motor connected to the rotation apparatus that moves the resistive heating delivery apparatus around an angle ϕ.

DETAILED DESCRIPTION

The present invention is an apparatus employing resistive heating for the removal of an interior coating formed on an internal surface of an ornament including, but not limited to, holiday products such as Christmas ornaments. The interior surface of the ornament has a finite conductivity permitting current flow through the interior coated surface of the ornament. The ornament material has a much lower conductivity than the material of the interior coating. One polarity from an electrical source is connected to a distal tip of a resistive heating delivery element and the other polarity is connected to the interior surface of the ornament. The polarity connected to the interior surface of the ornament is over a large enough area to prevent local heating at a point of contact between the interior coating and the distal tip. When the distal tip is placed in contact with a point on the surface of the interior coating current flows from the distal tip to the surface of the interior coating. As the current leaves the point of contact, the current spreads out over the entire internal surface of the ornament. However, at the point of contact the current is strongly localized and causes a resistive heating of the interior coating material. The resistive heating of the interior coating surface causes a rapid heating of the surface which removes the coating material. Once the material is removed the flow current stops because the distal tip is no longer in contact with the interior coating and is only in contact with the ornament material, which has a much lower conductivity. Stopping of the ablation process permits the removal of coating material to occur in a very localized region around the point of contact of the distal tip with the interior coating. By moving the distal tip to a new location the ablation process is repeated at that new location. Utilizing an electronic switching technique, the electrical source is turned on and off to produce regions where the surface is ablated or not ablated. In the absence of electrical power the distal tip is able to pass over the interior coating without mechanically scratching or removing it from the ornament.

The apparatus of the present invention includes motion controlled hardware to move the distal tip over the interior coating and a signal control system which controls the removal of the interior coating material from the surface of the ornament. Since the ornament usually consists of a hollow body with one opening, the ornament is typically rotated around an axis formed by the opening of the ornament and center of the spheroidal ornament. The ornament can be positioned in a stationary mode or it can also be translated and moved during the creation of the desired pattern.

Figure 1:
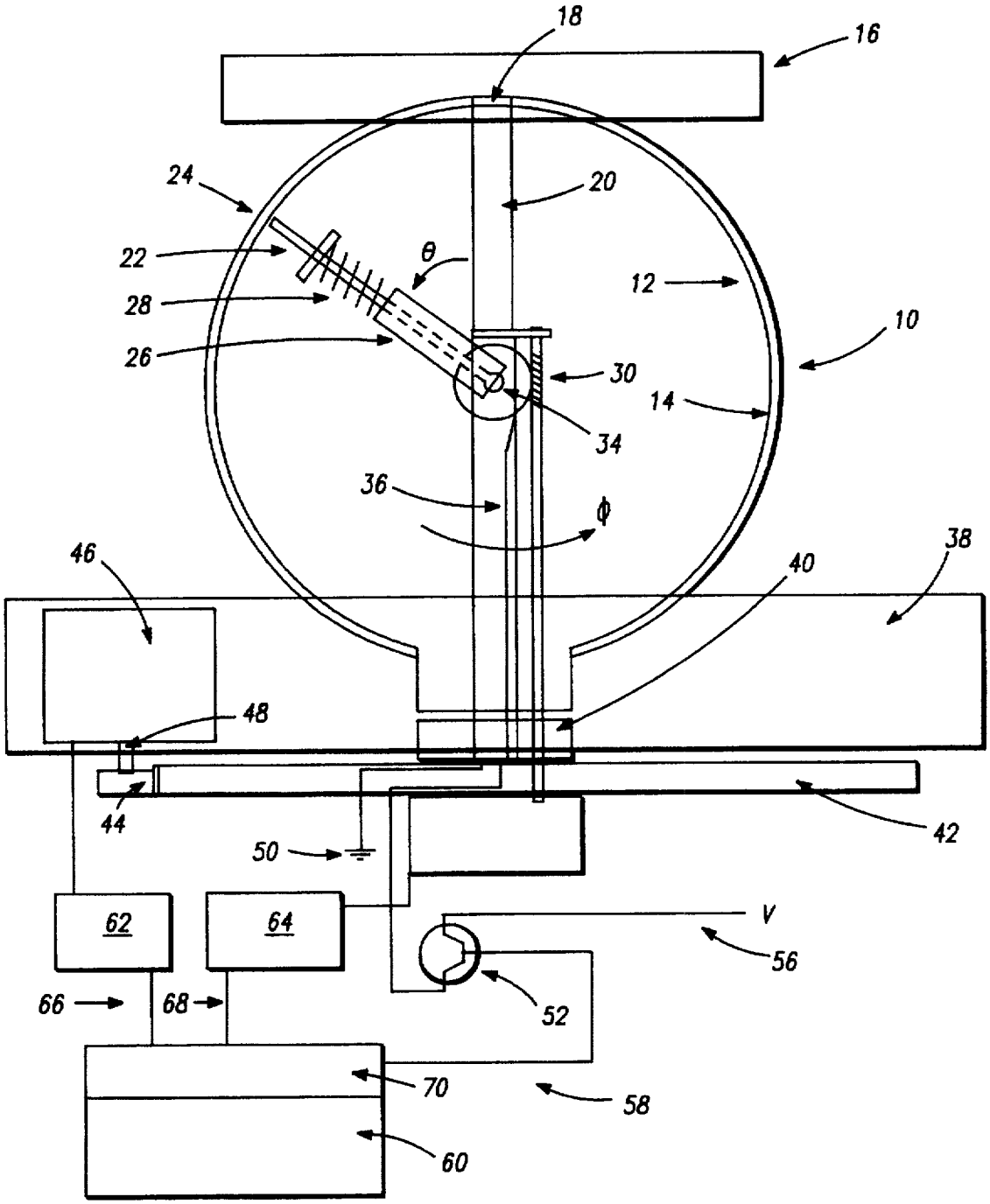
FIG. 1 is a schematic diagram of the resistive heating apparatus of the present invention.

Referring now to FIG. 1, the resistive heating apparatus for creating a pattern in the interior coating of an interior surface of the ornament includes an ornament 10 including an interior surface 12 on which an interior coating material 14 is deposited. An ornament restraining device 16 provides a mechanism for clamping and retaining the ornament in place. Suitable restraining devices include, but are not limited to movable clamps, which allow the ornament to be held in place but can be moved to a different location to allow the removal of the ornament. A ground contact pad 18 is a large electrical pad for carrying current away from interior 14. Suitable sizes for ground contact pad are in the range of about 0.26–1 $cm^2$ in area. It is preferred that the surface area of ground contact pad 18 should be much larger than a point of contact where electrical energy is discharged to the interior coating 14.

A support post 20 serves as a support for ground contact pad 18. Support post 20 is positioned within interior 12 in the stationary ornament case, the contact pad may be placed almost anywhere inside the ornament where it will not interfere with the creation of the pattern. In the moving ornament case, the most convenient place is at the point defined by the axis of rotation, opposite the opening in the ornament. However, the contact pad in the rotation case could also be a contact clip at the neck of the ornament.

The resistive heating apparatus includes a resistive heating delivery element 22 with a distal tip 24. Distal tip 24 is positioned in direct contact, or nearly direct, contact with interior coating 14 and delivers electrical energy or other suitable energy to interior coating 14, thus creating the desired pattern.

In one embodiment distal tip 24 comprises a single wire producing a fine line of about 25–500 microns (0.001" to 0.020"). The point of contact can also include a multiplicity of distal tips 24 forming a "print head" for the resistive heating apparatus. Each of the multiplicity of distal tips 24 are then independently controlled by a signal generating system which can include any number of components, as more fully explained below. Distal tip 24 is preferably made of a stiff material including, but not limited to tungsten, which prevents distal tip 24 from moving, stainless steel, nickel, both commonly used in "music wire" which can be obtained in a wide variety of sizes. Distal tip 24 can have a variety of geometric configurations. In one embodiment, distal tip 24 is rounded in order to reduce the possibility of mechanically scratching interior coating 14.

A support structure including, but not limited to a supporting column for distal tip support 26 adds strength to distal tip 24. Distal tip support 26 can be constructed of a variety of materials including but not limited to hypodermic tubing made from stainless steel or other suitable material. Ceramic or sapphire tubing or alternatively distal tip support 26 may be a larger diameter of the same material as distal tip 24. A restraining system 28 is utilized to keep a small amount of pressure on the point of contact between distal tip 24 and interior coating 14. The restraining system may be a spring. The amount of pressure is set such that distal tip 24 is always located against interior coating 14, but the pressure is not high enough to scratch interior coating 14. Further, restraining system 28 can be engaged with an electronically controlled solenoid system in order to position distal tip 24 against interior coating 14 during and lift distal tip 24 from the surface of interior coating 14 when distal tip 24 is not actively ablating material, the restraining system can also be activated with a pneumatic or hydraulic system as well.

A gearing system 30 is used to move distal tip 24 in an angle θ. In one embodiment, gearing system 30 is a worm drive gear system which is connected to a drive motor 32. Also included are a variety of mechanical devices including belts, gears, hydraulics, pneumatics, and other devices that provide a rotational motion to distal tip 24.

An arm bend 34 is connected to resistive heating delivery element 22 and provides a flexible conductor of electricity to distal tip 24. A support post 36 supports arm bend 34 and the distal tip 24 system. Disposed in an opposite position from ornament restraining device 16 is a support block 38 which provides mechanical support for a stationary ornament 10 as well as support for a variety of other elements including a motor gearing assembly. A bearing 40 provides isolation of motion of the rotation of support post 36 from support 38. A rotation gear 42 rotates the entire resistive heating delivery element around an angle ϕ. As illustrated in FIG. 1, the entire resistive heating delivery element 22 is mounting to rotation gear system 42. Rotation can be achieved through a variety of mechanical means including but not limited to gears, pulleys, belts, differential gears, push rods, and pneumatic or hydraulic systems. A rotation gear 44 is connected to a drive motor 46 via a motor shaft 48.

Drive motor 46 can be an electronically driven stepper motor or equivalent DC servo motors. In one embodiment drive motor 48 is connected to a rotation angle θ system while drive motor 32 is connected to rotation gear 42.

The resistive heating apparatus includes a ground system 50, connected to ground pad 18, an electronic switch 52 which can include transistors, MOSFET, relays, voltage controlled amplifers, and the like.

Figure 2:
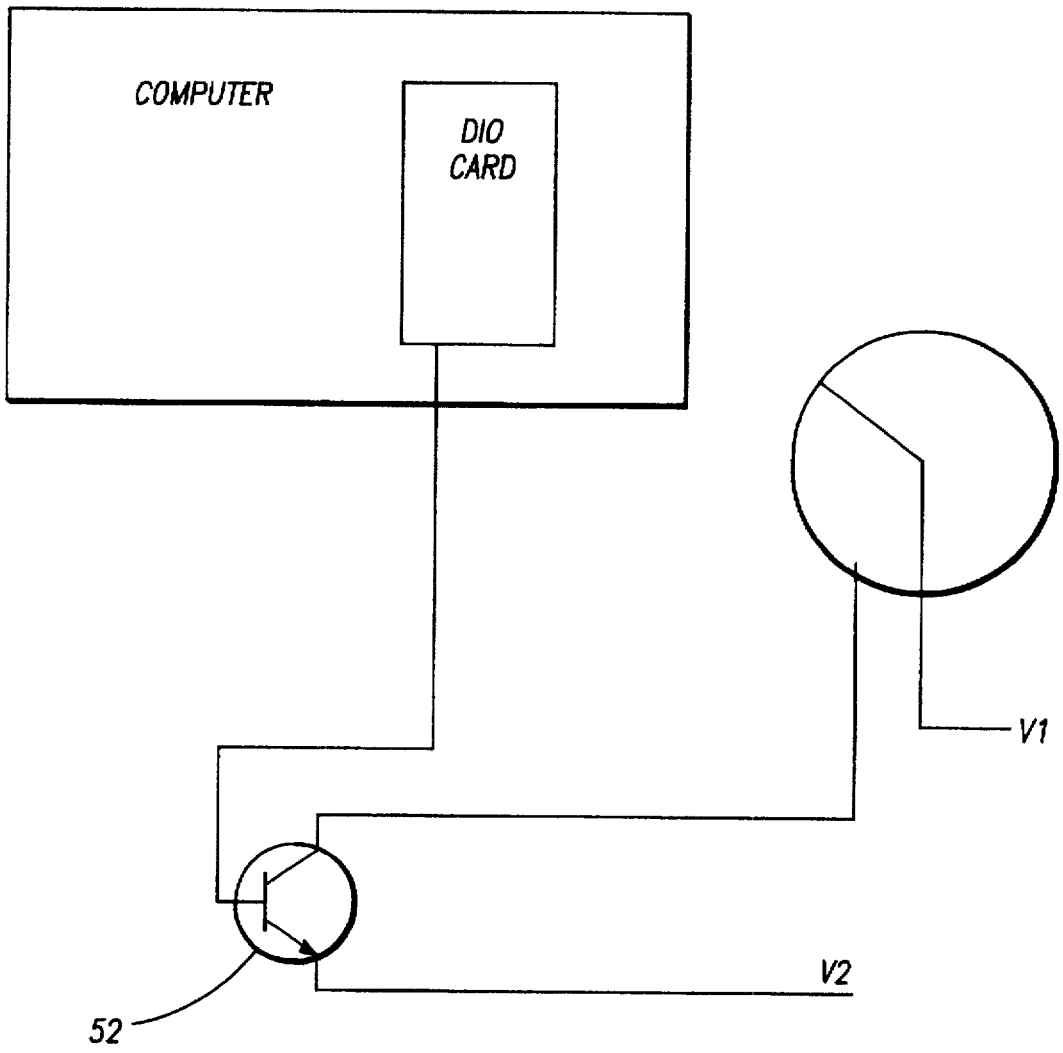
FIG. 2 illustrates an embodiment of the invention using a single wire system with NPN transistor as a switch.

Referring now to FIG. 2, one embodiment of electronic switch 52 is illustrated. The embodiment illustrated in FIG. 2 utilizes a single wire system with an NPN transistor as the switch. The transistor type may be an NTE 54, available from NTE Electronics, Inc., Bloomfield, N. J. However, switch 52 may be other types including but not limited to MOSFET, relays, PNP transistors, operation amplifiers, and the like.

Figure 3:
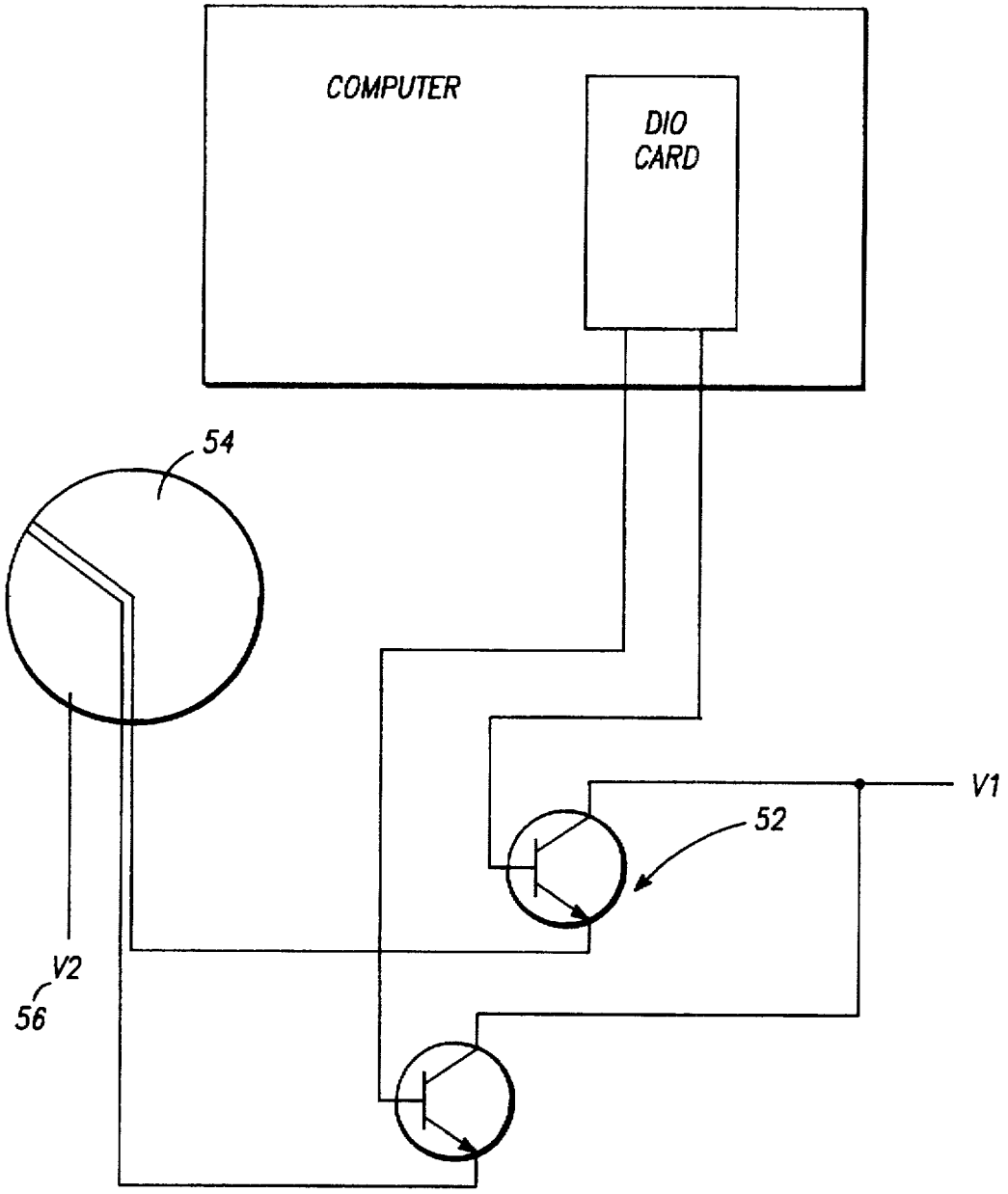
FIG. 3 is a second embodiment of the present invention with a multiplicity of wires to form a print head and each print head is controlled by a switching system.

Referring now to FIG. 3, a multiplicity of wires are used to form a print head 54. As illustrated in FIG. 3., an NPN transistor is utilized. However, it will be appreciated that other types of switches, including those list above, may also be utilized. Voltage source 56 can be of any kind of DC or AC power supply. Voltage source 56 can be a capacitor to store a fixed about of electrical energy which is triggered and discharged in ornament 10.

Referring again to FIG. 1, voltage source 56 is connected to electronic switch 52. A control signal 58 is generated from a computer 60 and is received at electronic switch 52. Motor drives 62 and 64 receive signals 66 and 68, respectfully, from computer 60. A controller 70 may also be included in the apparatus.

In operation, distal tip 24 is in a position that does not interfere with the placement of ornament 10 on the resistive heating apparatus. Ornament 10 is positioned and held in place. Signals from computer 60 move distal tip 24 in a pattern across interior coating 14. The voltage to distal tip 24 is controlled by electronic switch 52 which turns voltage on and off to create the desired pattern in interior coating 14. After the pattern has been created, distal tip 24 is placed in a position that does not interfere with the removal of ornament 10, which is thereafter removed.

Computer 60 can be any general use computer system independent of processor or architecture as long as computer 60 is able to communicate with the motion control and signal generation systems of the resistive heating apparatus. The motion control system can be a combination of a motor and a controller. Examples of such systems include motor type, controller type and communications method are as follows:

Stepper motor, programmable indexer, RS 232 communications.

SLO-SYN MO 61FF206 Stepper motor.

SLO-SYN SS2001 programmable controller, commercially available from Superior Electric, Bristol, Conn.

Stepper motor, microstepping driver, TTL communications.

AMSI 402SM stepper motor.

AMSI 7100-DB microstepping drive.

AMSI Corp., Smithtown, N.Y.

CIO-DIO24 digital I/O card, AMSI.

DC server motor, optical encoder, analog control.

commercially available from American Precision Industries, Buffalo, N.Y.

The foregoing description of a preferred embodiment of the invention has been presented for purposes of illustration and description. It is not intended to be exhaustive or to limit the invention to the precise forms disclosed. Obviously, many modifications and variations will be apparent to practitioners skilled in this art. It is intended that the scope of the invention be defined by the following claims and their equivalents.

What is claimed is:

1. An apparatus for creating a pattern in an interior coating of an ornament having an interior surface, comprising:

a support apparatus for supporting the ornament;

an energy source;

a resistive heating apparatus including a resistive heating delivery element with a distal tip that delivers ablative energy from the energy source to the interior coating of the ornament;

a motion control device associated with the resistive heating apparatus, the motion control device providing movement of the resistive heating delivery element distal tip in two or more orthogonal directions in the interior of the ornament; and a signal generating apparatus connected to the motion control device and producing a signal to the motion control device resulting in movement of the resistive heating delivery element and its distal tip.

2. The apparatus of claim 1, wherein the support apparatus includes a support post positioned in the interior of the ornament to support the ornament in a stationary position.

3. The apparatus of claim 1, wherein the support apparatus includes a support post positioned in the interior of the ornament to support the ornament in a non-stationary position.

4. The apparatus of claim 1, further comprising:

a ground contact pad positioned in the interior of the of the ornament.

5. The apparatus of claim 4, further comprising:

a support member to support the ground contact pad in the interior of the ornament.

6. The apparatus of claim 1, wherein the interior surface of the ornament has a lower conductivity than the interior coating.

7. The apparatus of claim 1, wherein the energy source has a first polarity connected to the resistive heating delivery element and a second polarity connected to the interior surface of the ornament.

8. The apparatus of claim 1, wherein the interior coating is a metallized coating.

9. The apparatus of claim 1, wherein the resistive heating delivery element distal tip is a single wire.

10. The apparatus of claim 1, wherein the resistive heating delivery element distal tip is a plurality of contact wires.

11. The apparatus of claim 10, wherein the plurality of contact wires form a print head.

12. The apparatus of claim 1, further comprising:

a resistive heating delivery element support member providing additional strength to the resistive heating delivery element.

13. The apparatus of claim 1, further comprising:

a gearing apparatus that moves the resistive heating delivery element in an angle θ.

14. The apparatus of claim 13, wherein the gearing apparatus comprises a worm drive gear system connected to a drive motor.

15. The apparatus of claim 1, further comprising:

a rotation apparatus that moves the resistive heating delivery apparatus around an angle ϕ.

16. The apparatus of claim 15, wherein the rotation apparatus comprises a gear connected to a motor shaft.

17. The apparatus of claim 1, further comprising a first drive motor connected to a gearing apparatus that moves the resistive heating delivery element in an angle θ, and a second drive motor connected to a rotation apparatus that moves the resistive heating delivery apparatus around an angle ϕ.

18. A method of forming a pattern in an interior coating of an interior of an ornament, comprising:

providing a resistive heating apparatus including a resistive heating delivery element with a distal tip that delivers ablation energy from an energy source to the interior coating of the ornament;

contacting the resistive heating delivery element with the interior coating;

delivering electrical energy from the energy source and resistive heating delivery element to the interior coating of the ornament; and ablating the interior coating where it is adjacent to the distal tip of the resistive heating delivery element.

19. The method of claim 18, further comprising:

moving the interior of the ornament in at least two orthogonal directions.

20. The method of claim 18, wherein an ornament material has a lower conductivity than the interior coating.

21. The method of claim 18, wherein the pattern is a design suitable for a holiday.

22. The method of claim 18, wherein the pattern is a Christmas design.

23. The method of claim 18, wherein the pattern is similar to a picture from a photograph.

24. The method of claim 18, wherein the resistive heating apparatus produces bitmaps to create photographs as the pattern.

25. The method of claim 18, further comprising:

moving the resistive heating delivery element distal tip in the interior of the ornament in an angle θ.

26. The method of claim 25, further comprising:

rotating the resistive heating delivery element distal tip in the interior of the ornament in an angle θ.

27. The method of claim 18, wherein the distal tip of the resistive heating delivery apparatus is in contact with the interior coating and delivers a strongly localized current to the interior coating and resistive heating at a point of contact.

28. The method of claim 27 wherein the resistive heating of interior coating causes a rapid heating and ablation at the point of contact.

29. The method of claim 28, wherein a flow of current to the distal tip ends when the ablation at the point of contact is completed.

30. The method of claim 18, further comprising:

switching the electrical energy delivered to the distal tip on and off.

31. The method of claim 30, wherein when the delivery of electrical energy to the distal tip is switched off the distal tip can be pass over a surface of the interior coating without ablating the interior coating.

* * * * *